US006836642B2

(12) United States Patent
Miyake

(10) Patent No.: US 6,836,642 B2
(45) Date of Patent: Dec. 28, 2004

(54) SHEET CONVEYING APPARATUS AND IMAGE FORMING APPARATUS

(75) Inventor: Hiroaki Miyake, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/270,048

(22) Filed: Oct. 15, 2002

(65) Prior Publication Data

US 2003/0081957 A1 May 1, 2003

(30) Foreign Application Priority Data

Oct. 30, 2001 (JP) ..... 2001-332283

(51) Int. Cl.[7] ..... G03G 15/00
(52) U.S. Cl. ..... 399/401; 399/13
(58) Field of Search ..... 399/13, 16, 107, 399/110, 124, 401, 402, 405

(56) References Cited

U.S. PATENT DOCUMENTS 4,234,305 A 11/1980 Miyake et al. ..... 432/59
5,280,331 A * 1/1994 Namiki ..... 399/124
5,365,311 A * 11/1994 Matsuoka ..... 399/13
5,579,098 A * 11/1996 Noguchi et al. ..... 399/124 X
5,708,954 A * 1/1998 Ando et al. ..... 399/402
5,775,686 A 7/1998 Miyake ..... 271/127
5,839,032 A * 11/1998 Yasui et al. ..... 399/124
5,872,900 A * 2/1999 Tsuchitoi ..... 399/401 X
6,289,183 B1 9/2001 Miyake ..... 399/16
6,330,425 B1 * 12/2001 Ohuchi et al. ..... 399/401
6,398,212 B1 6/2002 Miyake ..... 271/186
6,402,133 B1 6/2002 Miyake ..... 271/3.19

FOREIGN PATENT DOCUMENTS

JP 5-127456 5/1993

* cited by examiner

*Primary Examiner*—Sandra L. Brase
(74) *Attorney, Agent, or Firm*—FItzpatrick, Cella, Harper & Scinto

(57) ABSTRACT

A sheet conveying apparatus and an image forming apparatus of the present invention enable a user himself or herself to select a plurality of double-sided recording modes by use of one common image forming apparatus. Each of the sheet conveying apparatus and the image forming apparatus includes a first reversing member, provided in an apparatus main body, for reversing a sheet on which an image is recorded by an image forming unit, a conveying unit including a second reversing member for reversing the sheet on which the image is recorded by the image forming unit, and so provided as detachably attachable to the apparatus main body, and a double-sided conveying portion for conveying the reversed sheet again to the image forming unit in order to perform double-sided recording.

22 Claims, 7 Drawing Sheets

SHEET CONVEYING APPARATUS AND IMAGE FORMING APPARATUS

BACKGROUND OF THE INVENTION

1. Field of the Invention

The present invention relates to an image forming apparatus such as a copying machine etc. and, in particular, to the apparatus capable of improving a productivity particularly in double-sided recording.

2. Related Background Art

An image forming apparatus such a copying machine etc. has been digitized over the recent years, and, with this digitization, a configuration including a discharge portion provided in a spatial area formed within an apparatus main body (which will hereinafter be termed an "intra-apparatus discharge") is widely utilized. At the same time, a sheet fed from a sheet feeding means disposed under the apparatus main body, is conveyed substantially in a perpendicular direction, and an image is recorded on the sheet between it and the discharge portion disposed upward, thereby scheming to decrease a time (for forming the first image) of a first copy by reducing a length of a conveying path. What is practiced in this case is a control method of conveying two or three sheets simultaneously to within the apparatus main body by increasing a conveying speed when reversing and within a double-sided unit and shortening a sheet interval to the greatest possible degree in order to improve the productivity in the double-sided recording.

One of the configurations for the double-sided recording in the conventional image forming apparatuses, is that in the image forming apparatus shown in FIG. 7, the sheet supplied from a sheet supply portion 100 provided under the apparatus is conveyed upwards substantially in the perpendicular direction and is, after an image bearing member 101 has formed an image thereon, discharged to a discharge portion 103 disposed upwardly of the apparatus. A discharge roller 102 serving as a reversing roller reverses a conveying direction of the sheet conveyed to the discharge portion 103 and re-feeds the sheet to the image bearing member 101 through a double-sided conveying path 105 in a double-sided unit 104, thereby forming the images on both of surfaces of the sheet.

According to the configuration for the double-sided recording by the image forming apparatus in the first example of the prior art given above, the conveying roller 102 is used as both of the conveying roller and the reversing roller and is therefore incapable of discharging other sheets during a process of reverting the sheet. Therefore, this apparatus has an advantage of decreasing a production cost, and nevertheless the productivity decreased because of a necessity of widening a sheet interval for reversing the sheet when in the double-sided recording.

Further, in the image forming apparatus in another example of the prior art shown in FIG. 8, the sheet is similarly conveyed upwards substantially in the perpendicular direction from the sheet supply portion 100 provided downwardly of the apparatus and is, after the image bearing member 101 has formed the image thereon, discharged by the discharge roller 102 to the discharge portion 103 provided in the spatial area within the apparatus main body. Herein, a reversing roller 106 provided within a double-sided unit 104 separately from the discharge roller 102, reverses the sheet led to a reverse conveying path 107 within the double-sided unit 104, and thereafter sheet is fed again to the image bearing member 101 via the double-sided conveying path 105 in the double-sided unit 104, thereby forming the images on both of the surfaces of the sheet.

In the configuration in the second example of the prior art, by sharp contrast with the first example of the prior art given above, the productivity in the double-sided recording is improved because of the discharge roller and the reversing roller being different from each other, however, the extra roller and reverse conveying path are needed. Consequently, there arises a problem that the production cost rises and the apparatus increases in its size.

In any case, however, the user was given one option of the configurations for the double-sided recording by the image forming apparatus. Namely, the user must choose any one of the configuration putting more of emphasis on the productivity in the double-sided recording than the cost and the configuration putting the emphasis on the cost in a way that reduces the productivity in the double-sided recording.

SUMMARY OF THE INVENTION

Accordingly, it is a primary object of the present invention to provide a sheet conveying apparatus and an image forming apparatus each enabling a user himself or herself to select a plurality of configurations for double-sided recording by use of one common image forming apparatus.

To accomplish the above object, according to one aspect of the present invention, a sheet conveying apparatus has a first reversing member, provided in an apparatus main body, for reversing a sheet on which an image is recorded by an image forming unit, a conveying unit including a second reversing member for reversing the sheet on which the image is recorded by the image forming unit, and so provided as detachably attachable to the apparatus main body, and a double-sided conveying portion for conveying the reversed sheet again to the image forming unit in order to perform double-sided recording.

According to another aspect of the present invention, a sheet conveying apparatus has a discharge roller provided in an apparatus main body and capable of making forward and reverse rotations, this discharge roller discharging a sheet recorded with an image, which is conveyed from an image forming unit, or the discharge roller being capable of reversing the sheet by making its reverse rotations in the middle of discharging the sheet, a double-sided unit including a double-sided conveying path for conveying the sheet reversed by the discharge roller again to the image forming unit, a conveying unit including a reversing roller, so provided as to make forward and reverse rotations, for reversing the sheet by its making reverse rotations in the middle of conveying the sheet recorded with the image, which is sent from the image forming unit, and a unit conveying path for conveying the sheet reversed by the reversing roller, this conveying unit being so provided as to be detachably attachable to the apparatus main body, wherein when the conveying unit is attached to the apparatus main body, the unit conveying path is connected to the double-sided conveying path.

DESCRIPTION OF THE PREFERRED EMBODIMENTS

[First Embodiment]

Figure 1:
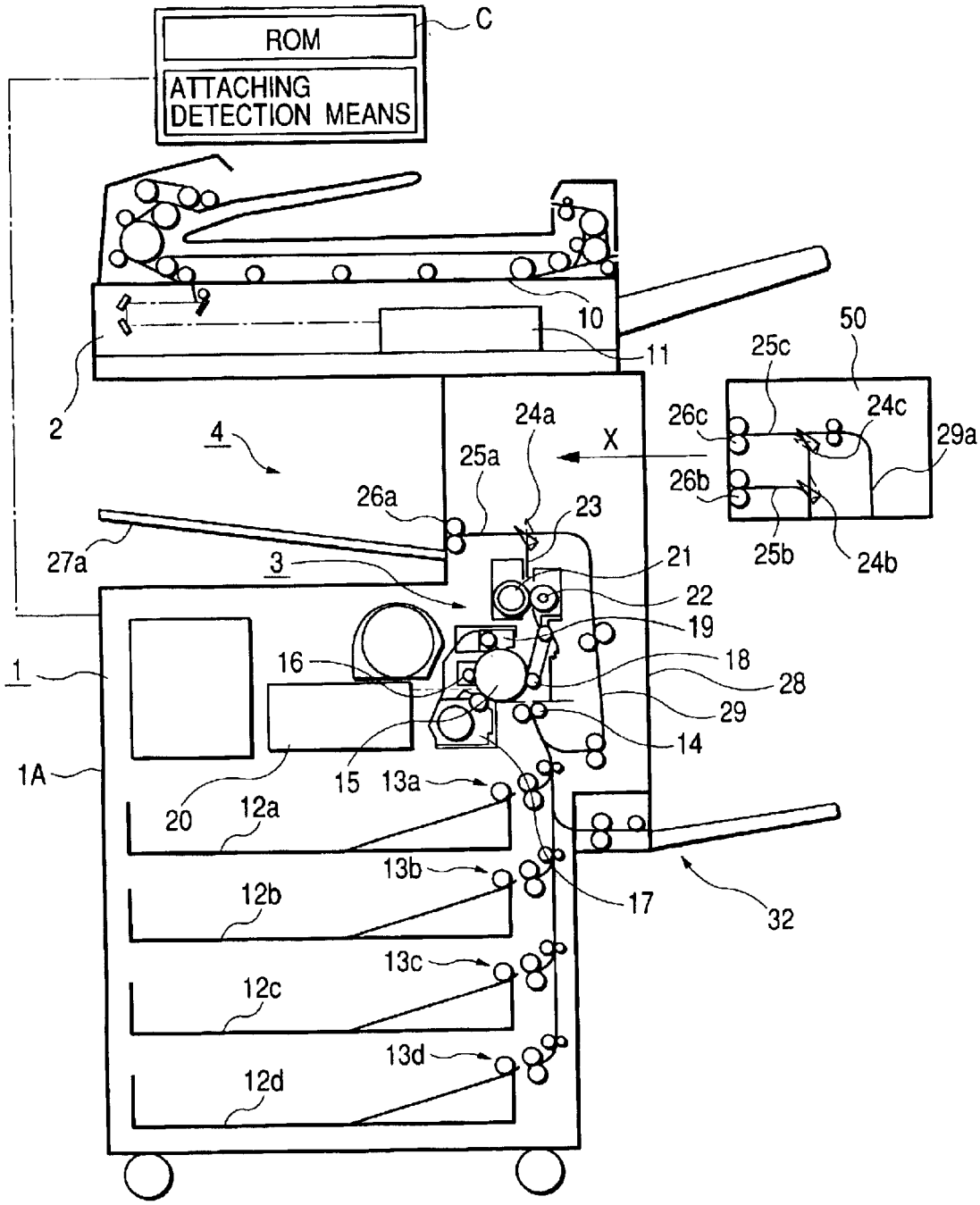
FIG. 1 is a view showing a whole configuration of an image forming apparatus in a pre-attached state of a conveying unit according to the present invention.
Figure 2:
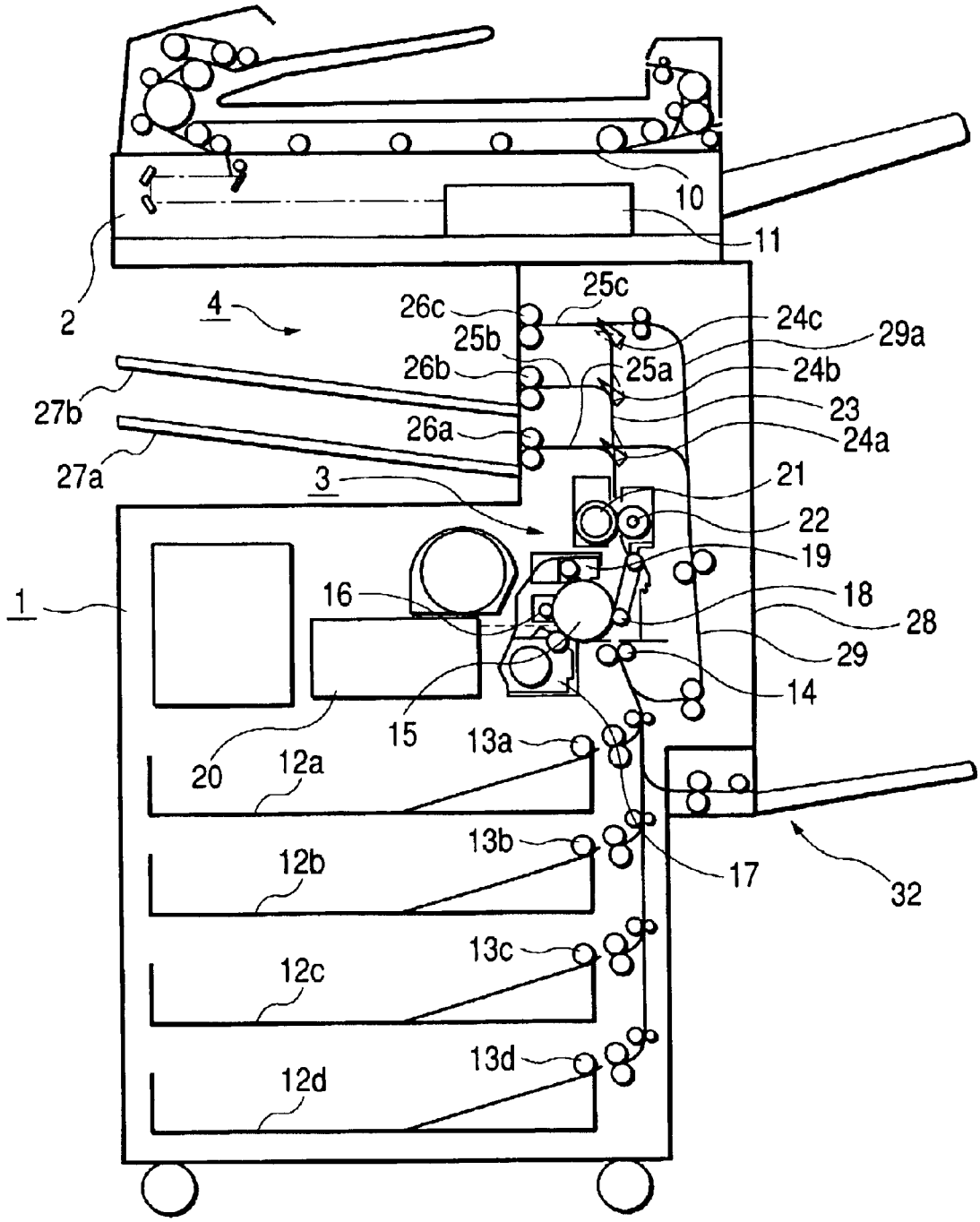
FIG. 2 is a view showing a whole configuration of the image forming apparatus in a post-attached state of the conveying unit according to the present invention.
Figure 3:
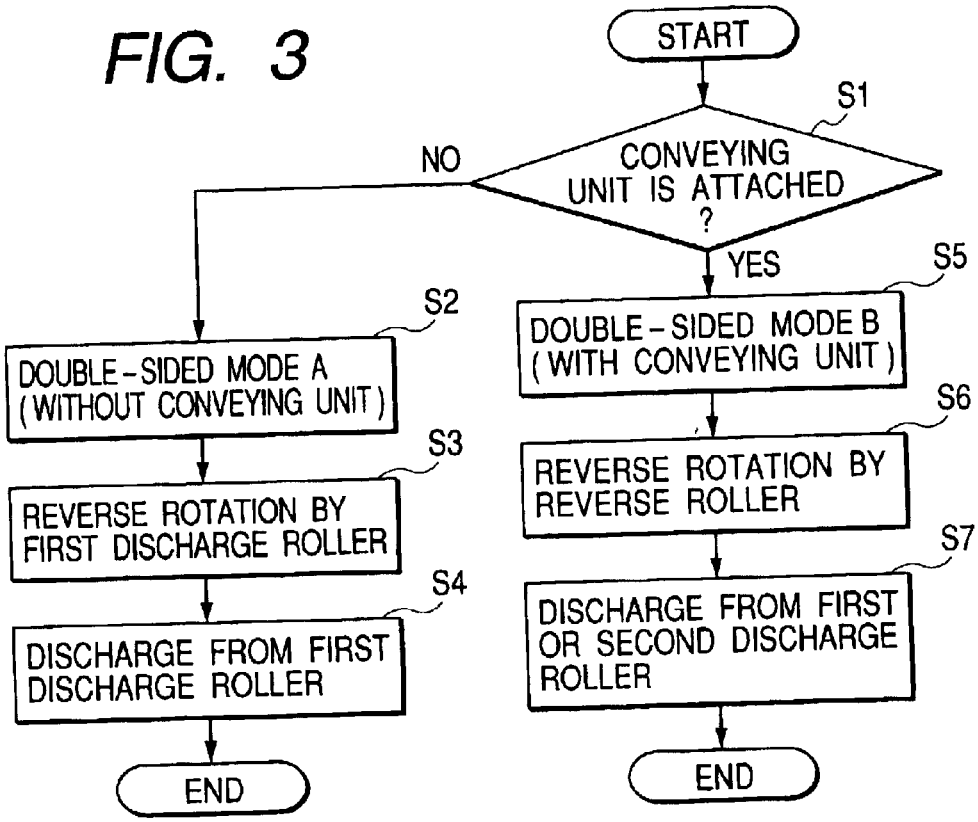
FIG. 3 is an explanatory flowchart showing a double-sided recording operation depending on whether the conveying unit according to the present invention is attached or not.
Figure 4:
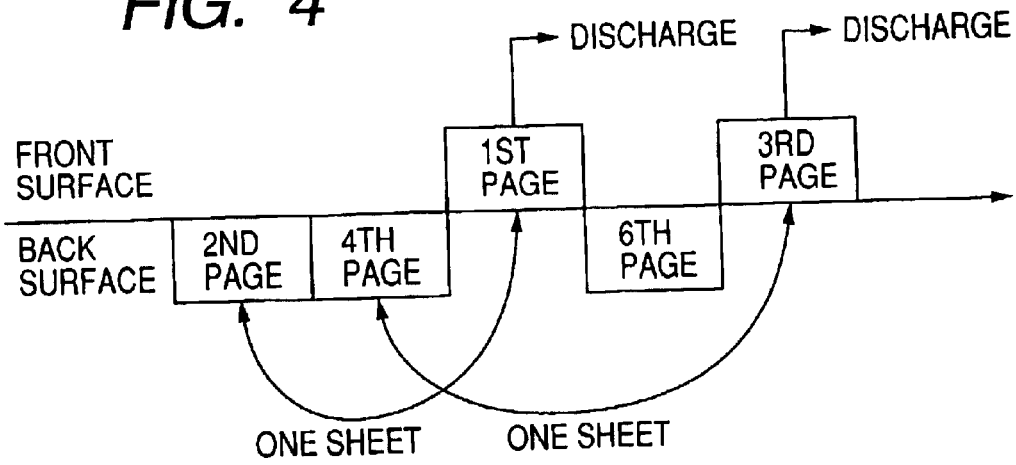
FIG. 4 is an explanatory diagram showing the double-sided recording operation in an image forming apparatus illustrated in FIG. 2.
Figure 5:
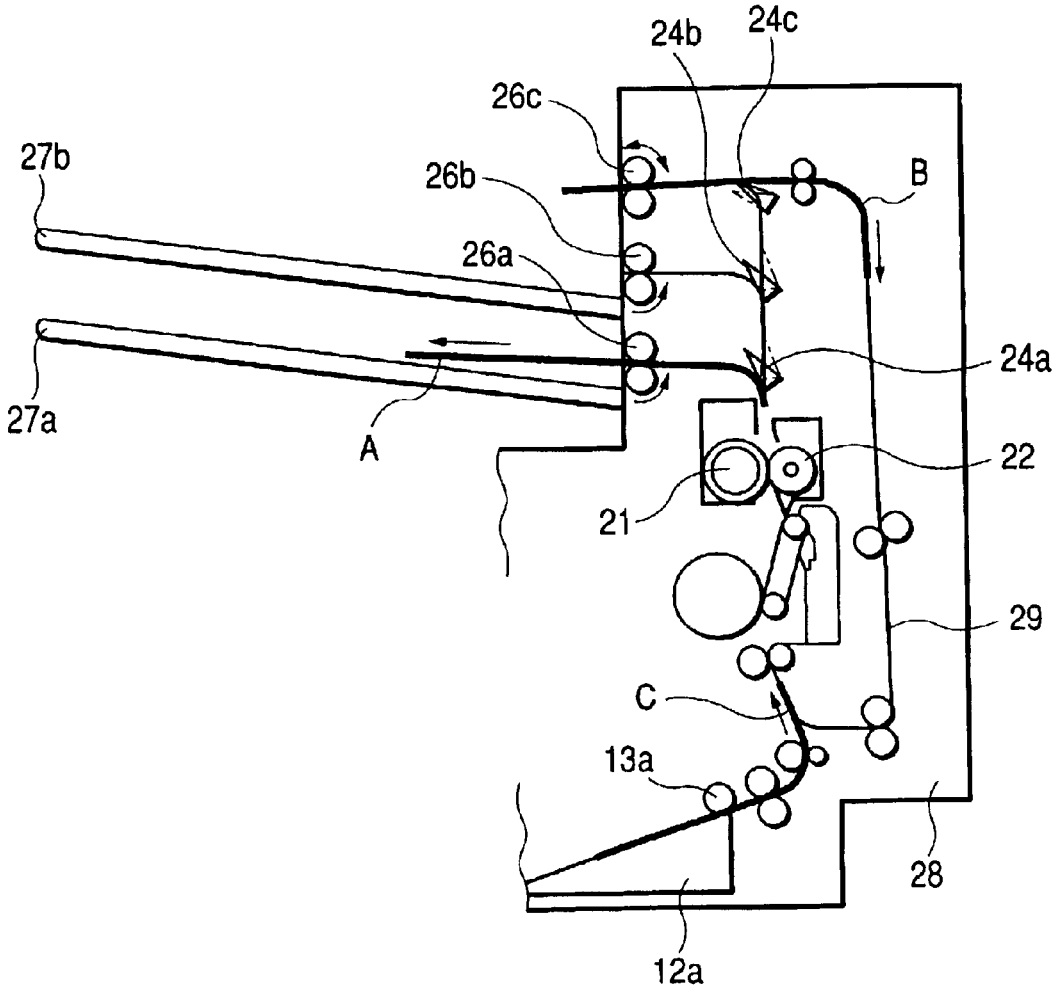
FIG. 5 is an explanatory view showing a flow of a sheet.

A first embodiment of a sheet conveying apparatus and an image forming apparatus according to the present invention will be described with reference to the accompanying drawings. FIG. 1 is a view showing a whole configuration of the image forming apparatus in a pre-attached state of a conveying unit. FIG. 2 is a view showing a whole configuration of the image forming apparatus in a post-attached state of the conveying unit. FIG. 3 is an explanatory flowchart showing a double-sided recording operation depending on whether the conveying unit is attached or not. FIG. 4 is an explanatory diagram showing the double-sided recording operation. FIG. 5 is an explanatory view showing a flow of a sheet.

An image forming apparatus 1 illustrated in FIG. 1 includes an image reading device 2 provided on an upper portion of an apparatus main body 1A. The image reading device 2 has an original placing glass 10 on which an original is placed, and a CCD sensor 11 defined as an image reading means. The image reading device 2 is a device for reading an image on the original in a way that operates the CCD sensor 11 to scan in reciprocation the original placed on the original placing glass 10 on the basis of an exposure start signal. The thus read image on the original is temporarily stored on an unillustrated memory means, and the image stored on the memory means can also undergo image processing such as reversing and so on.

A plurality of sheet cassettes 12*a* through 12*d* for stacking up and accommodating the sheets on which the images are recorded, are disposed under the apparatus main body 1A. The sheet cassettes 12*a* through 12*d* are provided with sheet feeding means 13*a* through 13*d* each including sheet feeding rollers, feed rollers and retard rollers (reversal rotation rollers). The sheets are fed sheet by sheet by the respective sheet feeding means 13*a* through 13*d* out of the sheet cassettes 12*a* through 12*d*. A side portion of the apparatus main body 1A is provided with a multi-sheet feeding unit 32 for supplying a variety of sizes and types of sheets.

Image information processed by the image reading device 2 is transmitted to an image forming unit 3, and, when a print command is issued, the sheets stacked in any one of the sheet cassettes 12*a* through 12*d* and the multi-sheet feeding unit 32 are fed sheet by sheet in separation and conveyed toward a couple of resist rollers 14 disposed upstream of the image forming unit 3.

The image forming unit 3 is disposed substantially at a central portion of the apparatus main body 1A, and is constructed of an image bearing member 15 and, as peripheral devices to the image bearing member 15, an electrifying device 16, a developing device 17, a transfer device 18 and a cleaning device 19.

The image bearing member 15 is uniformly electrified by the electrifying device 16, an electrostatic latent image is formed by its being exposed to laser beams emitted from a laser oscillation element 20 through an unillustrated polygon mirror etc., and the latent image is visualized as a toner image by the developing device 17. Then, the sheet is conveyed by the couple of resist rollers 14 aligned with the toner image on the image bearing member 15, and the toner image is transferred onto the sheet between the image bearing member 15 and the transfer device 18. The residual toner untransferred is cleaned off by the cleaning device 19, and the image bearing member 15 is on standby for forming a next image.

The sheet on which the toner image has been transferred is sent through a fixing apparatus constructed of a fixing roller having a built-in exothermic lamp and a pressuring roller 22 pressurized and rotationally driven by the fixing roller 21, whereby the image is fixed onto the sheet which is conveyed along a main conveying path to a discharge portion 4. Thus, the image on the first surface is formed.

(Discharge Portion)

The discharge portion 4 is disposed upwardly of the image forming unit 3 and downwardly of the image reading device 3. As illustrated in FIG. 1, the image forming apparatus in this embodiment includes as basic components a first discharge roller 26*a* and a discharge tray 27*a*, wherein the sheet onto which the image is fixed by the fixing apparatus is sent to the first discharge roller 26*a* via a discharge path 25*a*.

The first discharge roller 26*a* serves as a discharge means for discharging the sheet to the discharge tray 27*a* and also as a first reversing means for reversing the sheet when effecting a double-sided image formation that will be explained later on. The first discharge roller 26*a* is so provided as to be capable of making forward and reverse rotations, whereby the sheet is discharged to the discharge tray 27*a* by unidirectional rotations thereof, then reversed by the first discharge roller 26*a* making the reversed rotation at a predetermined timing in the middle of discharging the sheet and can be thus conveyed toward inside the apparatus main body 1A.

(Double-Sided Unit)

The image forming apparatus 1 incorporates a double-sided recording function of forming an image on a back surface of the sheet of which the first surface side is recorded with the image by the image forming unit 3, and has a double-sided unit 28 provided on a side surface of the apparatus main body 1A in order to convey the sheet of which the first surface side is recorded with the image again to the image forming unit 3. Note that this double-sided unit may be integrally attached to the apparatus main body 1A and may also be detachably provided as a separate unit.

The conveying unit 28 is provided with a double-sided conveying path 29 for connecting a discharge path 25*a* to the conveying path disposed upstream of the resist roller 14 in order to send the sheet reversed by the first discharge roller 26*a* again to the image forming unit 3. Note that the sheet reversed by the first discharge roller 26*a* is sent by a switching gate 24*a* toward the double-sided conveying path 29.

(Option Conveying Unit)

An option conveying unit 50 is detachably constructed and can be attached to the apparatus main body 1A as the user demands. The conveying unit 50 includes a second discharge roller 26*b* defined as a second discharge means, a reversing roller 26*c* defined as a second reversing means, switching gates 24*b*, 24*c* for selecting the discharge paths 25*b*, 25*c*, and a double-sided conveying path 29*a* serving as a unit conveying path according to the present invention. An attaching method, though not particularly limited, is that the conveying unit 50 may be attached to the main body 1A in the direction of, for instance, an arrowhead X in FIG. 1 and fastened thereto by use of screws etc. according to this embodiment, the conveying unit 50 set attachable upwardly of the first discharge roller 26*a* within the discharge portion 4.

The reversing roller 26*c* is so provided as to be capable of making the forward and reverse rotations. The reversing roller 26 reversely rotates midways of conveying the sheet by its unidirectional rotations toward the discharge portion 4, whereby the sheet is reversed by drawing the sheet again into the apparatus main body 1A and can be thus re-conveyed to the image forming unit 3.

FIG. 2 is the view showing the whole configuration of the image forming apparatus in the attached state of the option conveying unit 50. When the option conveying unit 50 is attached to the apparatus main body 1A, the double-sided conveying path 29*a* of the conveying unit 50 is connected to the double-sided conveying path 29 of the double-sided unit 28.

The image forming apparatus 1 is provided with a control means C for controlling the respective operations for forming the image. Two types of double-sided sequences differing depending on whether the conveying unit 50 is attached or not, are written beforehand to an ROM (Read-Only memory) provided in the control means C. The attaching of the conveying unit 50 is detected by an attaching detection means. The attaching thereof may be detected based on judging whether the conveying unit 50 is attached by confirming a state of electrification in a way that uses one of signal lines extending within the conveying unit 50, and may also be detected from a user's key input indicating the attaching thereof on an operation unit.

As shown in FIG. 3, to start with, the attaching detection means detects whether the conveying unit 50 is attached or not (step 1, of which "step" will hereinafter be abbreviated to "S"), if not detected, (S2), a double-sided mode (a first double-sided mode) A that will be explained later on, is carried out. Whereas if detected, (S5), a double-sided mode (a second double-sided mode) B that will be explained later on, is carried out.

When performing the double-sided recording in the first double-sided mode A, i.e., in the state where the apparatus takes the basic configuration but does not include the conveying unit 50 attached thereto (see FIG. 1), the sheet conveyed along a main conveying path 23 is guided to the discharge path 25*a* and led by the first discharge roller 26*a* to the discharge tray 27*a* defined as a discharge stacking means. The first discharge roller 26*a* operates as a reversing means with respect to the sheet on which the image on the first surface is recorded, and the sheet is, the conveying direction being reversed with the sheet reversed in an as-seized state when fed by a predetermined quantity toward onto the discharge tray 27*a* of the discharge portion 4, thus sent again to the image forming unit 3, at which time the sheet is in a state of being reversed in its front and rear surfaces (S3). Thus, the sheet reversed by the first discharge roller 26*a* is led to the double-sided unit 28 provided on the side surface of the apparatus main body 1A and again conveyed to the couple of resist rollers 14 via the double-sided conveying path 29. At this time, the sheet is reversed in its front and rear surfaces as explained above with respect to the image bearing member 15, and the image is recorded on the second surface. Then, after-being recorded on the second surface, the sheet is discharged to the discharge tray 27*a*, thus sequentially stacking the sheets thereon (S4).

Though discussed in the prior art given above, however, if one reversing means (the first discharge roller 26*a*) serves as both of the reversing portion and the discharge portion, a merit in terms of cost is large, but the discharging and the reversing can not be processed simultaneously. Namely, the control must be done so that the sheet reversed when performing the double-sided recording passes through the discharge path 25*a*, and thereafter the next sheet enters the discharge path 25*a*. This involves widening a sheet interval, with the result that the productivity is hard to be improved. For example, in the case of obtaining ten copies of each of ten sheets of one-sided originals in the first double-sided mode A in the first embodiment, the productivity (which implies a ratio of a discharge speed to an image forming speed) is on the order of 65%.

When performing the double-sided recording in the second double-sided mode B, i.e., in the state where the conveying unit 50 is attached (see FIG. 2), at first the sheet of which the first surface is recorded with the image passes through the switching gates 24*a*, 24*b*, and is conveyed by the switching gate 24*c* to the reversing roller 26*c*, thus reversing the conveying direction (S5). Then, the sheet reversed by the reversing roller 26*c* is conveyed to the image forming unit 3 via the double-sided unit 28, wherein the image is recorded on the second surface. The sheet of which the second surface is recorded with the image is guided selectively to one of the discharge paths 25*a*, 25*b* by the switching gates 24*a*, 24*b* as the guide means, and discharged to the discharge tray 27*a* or 27*b* by the discharge roller 26*a* or 26*b*, thus stacking the sheets in sequence. The sheets can be sorted out in the discharge trays 27*a*, 27*b* by, for instance, a sort mode or by distributing the sheets based on a FAX output mode, a printer output mode etc. Note that the operations of the switching gates 24*a* through 24*c* are controlled unillustrated sheet sensors provided downstream of the fixing apparatus.

What is performed as the double-sided recording in the first embodiment is a through-pass double-sided recording by accumulating the images for a several sheets by use of the unillustrated memory means. The through-pass double-sided recording is, as illustrated in FIG. 4, that at first two sheets fed from the sheet cassette 12 are consecutively recorded with the images on their rear front and back surfaces (second and fourth pages), and then the image is recorded on the front surface of the first page by reversing the sheet (the first page). Thereafter, the images are sequentially recorded on the back surface (the sixth page) and the front surface (the third page) in order. A characteristic of this through-pass double-sided recording method is that the sheets are not temporarily stacked within the double-sided conveying path 29. With this operation repeated, it follows that the sheets are stacked on the discharge trays 27*a*, 27*b* in the page sequence in a way that discharge the sheet with its back surface directed under from the first page.

For the duration of the consecutive operations by performing the through-pass double-sided recording, according to the first embodiment, as illustrated in FIG. 5, three A4-sized sheets are conveyed simultaneously within the apparatus main body 1A. FIG. 5 shows a state where the sheet A undergoes the double-sided recording and is stacked on the discharge tray 27*a*, a state where the sheet B is reversed by the reversing roller 26*c* and conveyed to the double-sided conveying path 29, and a state where the sheet C is fed afresh from the sheet cassette 12. The reversing operation and the stacking operation are conducted simultaneously by use of the plurality of discharge rollers 26*a* through 26*c*, whereby the double-sided recording productivity can be improved. For example, in the case of obtaining ten copies of each of ten sheets of one-sided originals in the second double-sided mode in the first embodiment, the productivity (the ratio of the discharge speed to then image forming speed) becomes approximately 85% owing to the conveying unit 50 attached. Note that if a conveying speed of the revering portion and the double-sided conveying portion is accelerated over a photosensitive drum speed, a more slight improvement of the productivity can be acquired in any of the double-sided modes A and B.

In the sheet conveying apparatus and the image forming apparatus according to the present invention, the option conveying unit 50 is constructed in the detachably attachable manner, and hence the user himself or herself can select any one of the productivity-emphasized mode with the conveying unit 50 attached and the cost-emphasized mode with the conveying unit 50 unattached by use of the single common image forming apparatus.

Note that the discussion in the first embodiment has been made based on the configuration that the reversing roller 26*c* of two pieces of the discharge roller 26*b* and the reversing roller 26*c* provided in the conveying unit 50, is used as the reversing means, while the second discharge roller 26*b* is used as the discharge means. The present invention is not, however, limited to this configuration, wherein one discharge roller is provided in the conveying unit 50 and may be used as the reversing means, and this single discharge roller may also be made to serve as both of the reversing means and the discharge means. Further, two or more pieces of reversing means and discharge means may also be provided. Namely, the present invention has such a characteristic that the basic configuration of the apparatus includes the first reversing means serving as both of the reversing means and the discharge means, and at least one of the reversing means and the discharge means is added by the detachable/attachable conveying unit. Note that the reversing roller 26*c* may be given a discharge function of discharging the sheet in the first embodiment.

[Second Embodiment]

Figure 6:
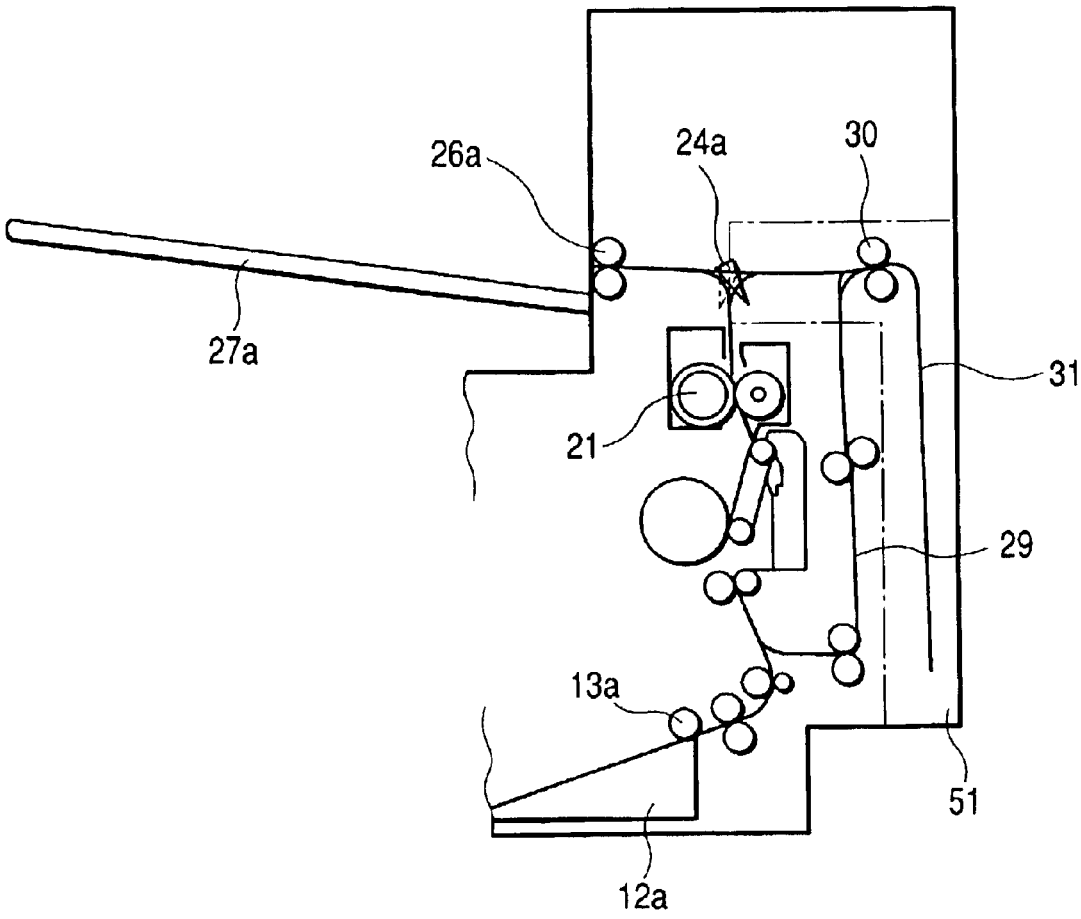
FIG. 6 is a view showing a whole configuration of the image forming apparatus in a post-attached state of the conveying unit of the image forming apparatus in a second embodiment.
Figure 7:
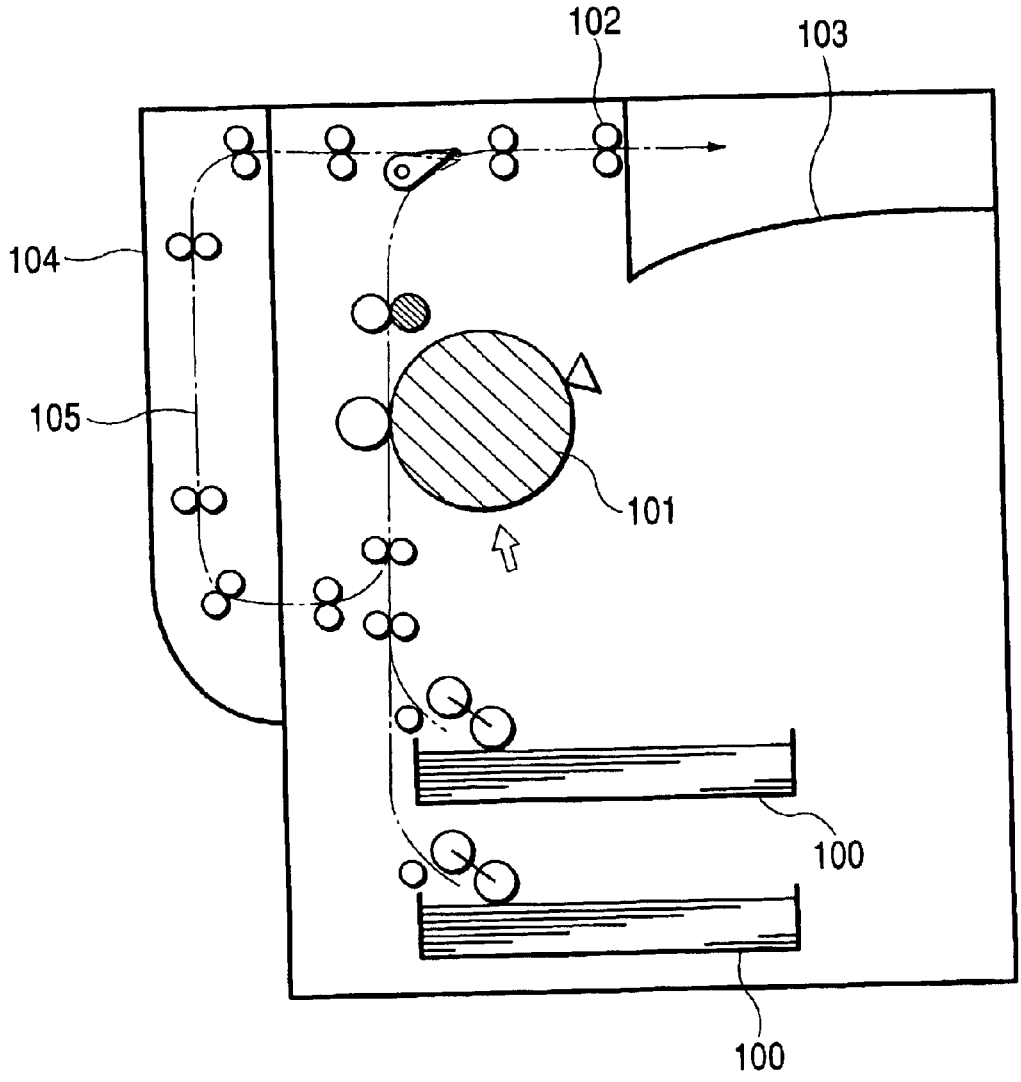
FIG. 7 is an explanatory view showing a configuration of an image forming apparatus capable of double-sided recording in the prior art.
Figure 8:
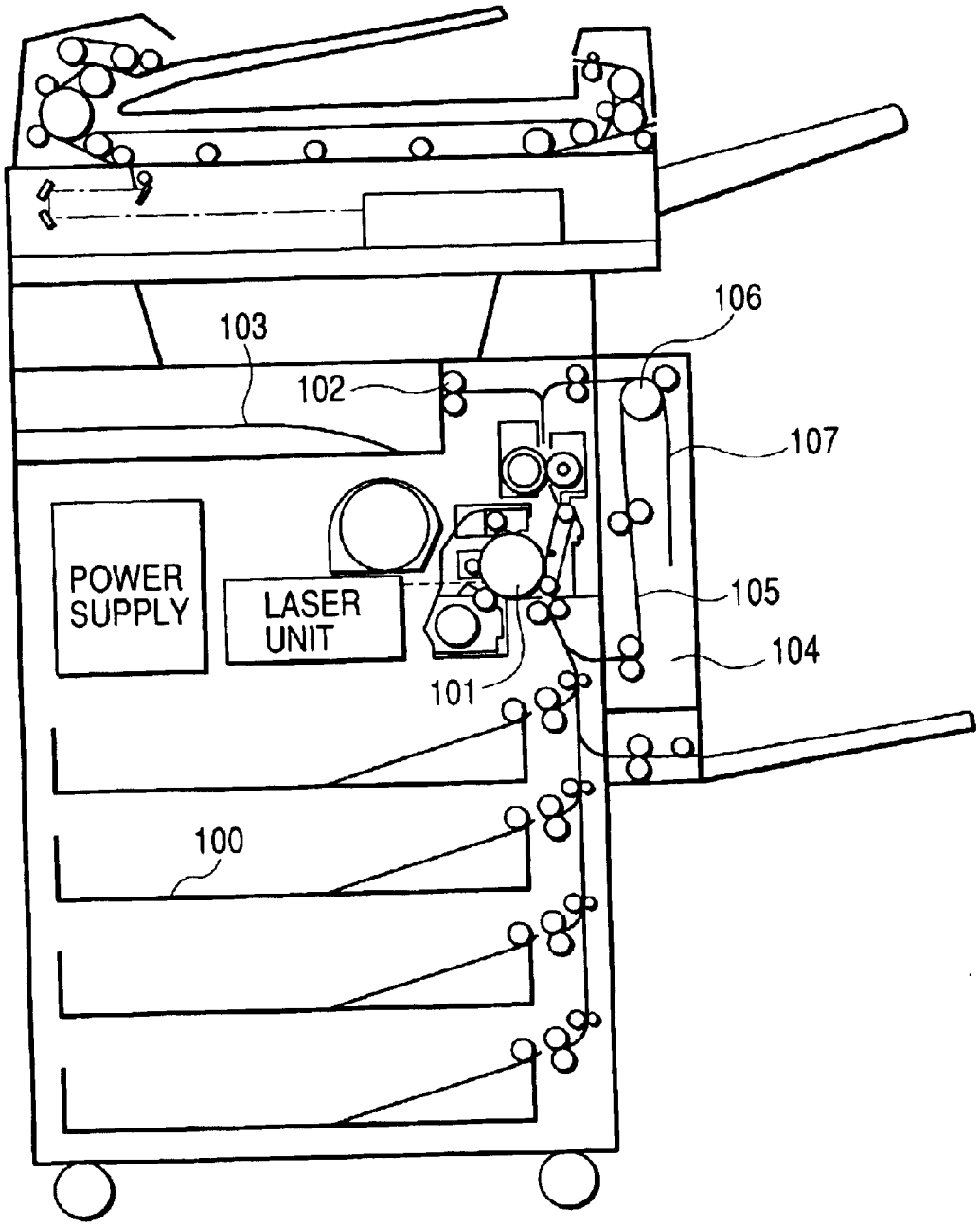
FIG. 8 is an explanatory view showing a configuration of the image forming apparatus capable of double-sided recording in the prior art.

A second embodiment of the sheet conveying apparatus and the image forming apparatus according to the present invention, will be discussed with reference to the drawings. FIG. 6 is a view showing a whole configuration of the image forming apparatus in a post-attached state of the conveying unit in the second embodiment, wherein the overlapped components in the discussion in the first embodiment are marked with the same numerals, and their repetitive explanations are omitted.

In the first embodiment discussed above, the conveying unit 50 is attachable upwardly of the first discharge roller 26*a* within the discharge portion 4. By contrast, a configuration in the second embodiment is that the conveying unit including a second reversing means is attached to and detached from the side surface of the apparatus.

A conveying unit 51 depicted by a broken line shown in FIG. 6 has a reversing roller and a revering path 31 that are defined as the second reversing means. When performing the double-sided recording by use of the thus constructed conveying unit 51, the sheet with an image recorded on its first surface, which is conveyed along the main conveying path 23, is led by the switching gate 24*a* to the reversing path 31 through the reversing roller 30. The reversing roller 30, conveying the sheet by a predetermined quantity, reverses the conveying direction in the as-seized state and re-conveys the sheet to the couple of resist rollers 14 via the double-sided conveying path 29. Thus, the reversing roller 30 and reversing path 31 dedicated to reversing are added, whereby the discharge can be effected simultaneously with reversing and the productivity by the double-sided recording can be improved.

Accordingly, with also the configuration as adopted in the second embodiment, it is possible to select the cost-emphasized double-sided recording mode in the apparatus based on the standard architecture and the productivity-emphasized double-sided recording mode by adding the option conveying unit 51, wherein the user himself or herself can choose these modes by use of one single common image forming apparatus.

Note that the sheet is conveyed vertically in the image forming apparatus according to each embodiment discussed above, however, the present invention is not confined to this vertical conveyance and can exhibit the same effects by adopting a configuration for a horizontal conveyance.

What is claimed is:

1. A sheet conveying apparatus comprising:

first reversing means, provided in an apparatus main body, for reversing a sheet on which an image is recorded by an image forming unit;

a conveying unit including second reversing means for reversing the sheet on which the image is recorded by said image forming unit, and so provided as detachable to the apparatus main body; and double-sided conveying means for conveying the reversed sheet which is reversed by said first reversing means or said second reversing means to said image forming unit again in order to perform double-sided recording.

2. A sheet conveying apparatus according to claim 1, wherein said first reversing means has a discharge function of discharging the sheet formed with the image, if said conveying unit is attached to the apparatus main body, the sheet with its one surface recorded with the image by said image forming unit is reversed by said second reversing means, and the sheet with its double surfaces recorded with the images by said image forming unit is discharged by said first reversing means.

3. A sheet conveying apparatus according to claim 1, further comprising control means for controlling the double-sided recording in a first double-sided mode for performing the double-sided recording in which the sheet is reversed by said first reversing means when said conveying unit is not attached to the apparatus main body, and in a second double-sided mode for performing the double-sided recording in which the sheet is reversed by said second reversing means when said conveying unit is attached to the apparatus main body.

4. A sheet conveying apparatus according to claim 3, further comprising attaching detection means for detecting attaching of said conveying unit, wherein said control means controls so as to perform the double-sided recording in the second double-sided mode on the basis of a detection, of the attachment of said conveying unit, by said attaching detection means.

5. A sheet conveying apparatus according to claim 4, wherein said attaching detection means detects the attaching of said conveying unit by use of at least one signal line of said conveying unit.

6. A sheet conveying apparatus according to claim 1, wherein said second reversing means serves as sheet discharge means for discharging the sheet on which the image is formed by said image forming unit.

7. A sheet conveying apparatus according to claim 1, wherein said conveying unit includes sheet discharge means for discharging the sheet on which the image is recorded by said image forming unit.

8. A sheet conveying apparatus comprising:

a discharge roller provided in an apparatus main body and capable of making forward and reverse rotations, said discharge roller discharging a sheet recorded with an image, which is conveyed from an image forming unit, or said discharge roller being capable of reversing the sheet by making its reverse rotations in the middle of discharging the sheet;

a double-sided unit including a double-sided conveying path for conveying the sheet reversed by said discharge roller again to said image forming unit;

a conveying unit including a reversing roller, so provided as to make forward and reverse rotations, for reversing the sheet by its making reverse rotations in the middle of conveying the sheet recorded with the image, which is set from said image forming unit, and a unit conveying path for conveying the sheet reversed by said reversing roller, said conveying unit being so provided as to be detachably attachable to the apparatus main body, wherein when said conveying unit is attached to the apparatus main body, said unit conveying path is connected to said double-sided conveying path.

9. A sheet conveying apparatus according to claim 8, further comprising control means for controlling the double-sided recording in a first double-sided mode for performing the double-sided recording in which the sheet is reversed by said discharge roller when said conveying unit is not attached to the apparatus main body, and in a second double-sided mode for performing the double-sided recording in which the sheet is reversed by said reversing roller of said conveying unit when said conveying unit is attached to the apparatus main body.

10. A sheet conveying apparatus according to claim 9, further comprising attaching detection means for detecting attaching of said conveying unit, wherein said control means controls so as to perform the double-sided recording in the second double-sided mode on the basis of a detection, of the attaching of said conveying unit, by said attaching detection means.

11. An image forming apparatus comprising:

an image forming unit for recording an image on a sheet;

first reversing means, provided in an apparatus main body, for reversing a sheet on which an image is recorded by said image forming unit;

a conveying unit including second reversing means for reversing the sheet on which the image is recorded by said image forming unit, and so provided as detachable to the apparatus main body; and double-sided conveying means for conveying the reversed sheet which is reversed by said first reversing means or said second reversing means to said image forming unit again in order to perform double-sided recording.

12. An image forming apparatus according to claim 11, wherein said first reversing means has a discharge function of discharging the sheet formed with the image, if said conveying unit is attached to the apparatus main body, the sheet with its one surface recorded with the image by said image forming unit is reversed by said second reversing means, and the sheet with its double surfaces recorded with the images by said image forming unit is discharged by said first reversing means.

13. An image forming apparatus according to claim 12, wherein said conveying unit includes sheet discharge means for discharging the sheet on which the image is recorded by said image forming unit.

14. An image forming apparatus according to claim 13, wherein said image forming unit is disposed so as to form the image on the sheet conveyed upwards, and when said conveying unit is attached to the apparatus main body, said first reversing means, said sheet discharge means and said second reversing means are disposed in this sequence in an upwardly vertical direction of said image forming unit.

15. An image forming apparatus according to claim 11, further comprising control means for controlling the double-sided recording in a first double-sided mode for performing the double-sided recording in which the sheet is reversed by said first reversing means when said conveying unit is not attached to the apparatus main body, and in a second double-sided mode for performing the double-sided recording in which the sheet is reversed by said second reversing means when said conveying unit is attached to the apparatus main body.

16. An image forming apparatus according to claim 11, further comprising image reading means for reading an image on an original, wherein a discharge portion for discharging the sheet formed with the image is provided upwardly of said image forming unit and under said image reading means, said conveying unit is so provided as to be detachably attachable upwardly of said first reversing means for discharging the sheet to said discharge portion, and said reversing means and said second reversing means, provided in said conveying unit, feed a part of the sheet to said discharge portion and then reverse the sheet.

17. An image forming apparatus comprising:

an image forming unit for recording an image on a sheet;

a discharge roller provided in an apparatus main body and capable of making forward and reverse rotations, said discharge roller discharging a sheet recorded with an image, which is conveyed from an image forming unit, or said discharge roller being capable of reversing the sheet by making its reverse rotations in the middle of discharging the sheet;

a double-sided unit including a double-sided conveying path for conveying the sheet reversed by said discharge roller again to said image forming unit;

a conveying unit including a reversing roller, so provided as to make forward and reverse rotations, for reversing the sheet by its making reverse rotations in the middle of conveying the sheet recorded with the image, which is sent from said image forming unit, and a unit conveying path for conveying the sheet reversed by said reversing roller, said conveying unit being so provided as to be detachably attachable to the apparatus main body, wherein when said conveying unit is attached to the apparatus main body, said unit conveying path is connected to said double-sided conveying path.

18. An image forming apparatus according to claim 17, further comprising control means for controlling the double-sided recording in a first double-sided mode for performing the double-sided recording in which the sheet is reversed by said discharge roller when said conveying unit is not attached to the apparatus main body, and in a second double-sided mode for performing the double-sided recording in which the sheet is reversed by said reversing roller of said conveying unit when said conveying unit is attached to the apparatus main body.

19. An image forming apparatus according to claim 18, further comprising attaching detection means for detecting attaching of said conveying unit, wherein said control means controls so as to perform the double-sided recording in the second double-sided mode on the basis of a detection, of the attaching of said conveying unit, by said attaching detection means.

20. An image forming apparatus according to claim 17, wherein said conveying unit includes a second discharge roller for discharging the sheet on which the image is recorded by said image forming unit.

21. An image forming apparatus according to claim 20, wherein said image forming unit is disposed so as to form the image on the sheet conveyed upwards, and when said conveying unit is attached to the apparatus main body, said discharge roller, said second discharge roller and said reversing roller are disposed in this sequence in an upwardly vertical direction of said image forming unit.

22. An image forming apparatus according to claim 17, further comprising image reading means for reading an image on an original, wherein a discharge portion for discharging the sheet formed with the image is provided upwardly of said image forming unit and under said image reading means, said conveying unit is so provided as to be detachably attachable upwardly of said discharge roller for discharging the sheet to said discharge portion, and said discharge roller and said reversing roller provided in said conveying unit, feed a part of the sheet to said discharge portion and then reverse the sheet.

* * * * *

UNITED STATES PATENT AND TRADEMARK OFFICE

CERTIFICATE OF CORRECTION

PATENT NO. : 6,836,642 B2
DATED : December 28, 2004
INVENTOR(S) : Hiroaki Miyake It is certified that error appears in the above-identified patent and that said Letters Patent is hereby corrected as shown below:

Title page,
Item [74], *Attorney, Agent or Firm*, "Fitzpatrick, Cella, Harper & Scinto" should read -- Fitzpatrick, Cella, Harper & Scinto --.

Column 1,
Line 12, "such" should read -- such as --.
Line 42, "of" should be deleted.

Column 2,
Line 13, "of" should be deleted.

Column 4,
Line 42, "inside" should read -- the inside of --.

Column 5,
Line 15, "midways" should read -- midway --.
Line 31, "an" should read -- a --.

Column 6,
Line 44, "for a" should read -- for --.
Line 46, "that at first" should read -- that, at first, --.

Column 7,
Line 12, "revering" should read -- reversing --.
Line 62, "revering" should read -- reversing --.

Column 8,
Line 9, "with also" should read -- also with --.

Column 9,
Line 23, "set" should read -- sent --.

UNITED STATES PATENT AND TRADEMARK OFFICE

CERTIFICATE OF CORRECTION

PATENT NO. : 6,836,642 B2
DATED : December 28, 2004
INVENTOR(S) : Hiroaki Miyake It is certified that error appears in the above-identified patent and that said Letters Patent is hereby corrected as shown below:

Column 12,
Line 17, "reversing roller" should read -- reversing roller, --.

Signed and Sealed this

Seventeenth Day of May, 2005

JON W. DUDAS
*Director of the United States Patent and Trademark Office*